United States Patent [19]

Nielsen

[11] 4,106,691

[45] Aug. 15, 1978

[54] VALVE ARRANGEMENT FOR REFRIGERATION PLANTS

[75] Inventor: Leif Nielsen, Nordborg, Denmark

[73] Assignee: Danfoss A/S, Nordborg, Denmark

[21] Appl. No.: 760,631

[22] Filed: Jan. 11, 1977

[30] Foreign Application Priority Data

Jan. 31, 1976 [DE] Fed. Rep. of Germany ..... 2603682

[51] Int. Cl.[2] ..... F25B 41/06

[52] U.S. Cl. ..... 236/92 B; 62/528

[58] Field of Search ..... 236/92 B; 62/225, 222, 62/223, 528

[56] References Cited

U.S. PATENT DOCUMENTS

| | | | |
|---|---|---|---|
| 2,922,292 | 1/1960 | Lange | 62/225 X |
| 3,934,426 | 1/1976 | Jespersen et al. | 62/225 X |

*Primary Examiner*—William E. Wayner

[57] ABSTRACT

The invention relates to a thermostatic valve assembly for refrigeration systems. The valve assembly is between the condenser and the evaporator and includes two valve units in series. The two valve units are shown integrated in one casing but could be provided with individual casings. The second valve unit has the conventional thermostatic function while the first valve unit functions to isolate the second valve unit from the effects of varying condenser pressures which go from high in the winter to low in the summer. In a pressure chamber between the two valve units a mean pressure is maintained which is between the condenser and evaporator pressures. The first valve unit is controlled by a balancing between opening forces created by evaporator pressure and a differential spring and a closing force created by the mean pressure in the mean pressure chamber. In this way the mean pressure is constantly maintained larger than the evaporator pressure by a predetermined difference and the effects of a varying condenser pressure are substantially minimized.

4 Claims, 3 Drawing Figures

VALVE ARRANGEMENT FOR REFRIGERATION PLANTS

The invention relates to a valve arrangement for refrigeration plants for placement between the condenser, particularly an air-cooled condenser, and the evaporator, comprising two series-connected throttle points of which the first is loaded in the closed direction under the influence of the mean pressure between the throttle points and in the open direction by an opening force and is substantially relieved in relation to the condenser pressure, and the second is formed by a thermostatic expansion valve.

If only one thermostatic expansion valve is interposed between the condenser and evaporator and works with an operating element governed by the superheated temperature of the evaporator, difficulties arise if the condenser pressure fluctuates. In the summer, particularly with air-cooled condensers, condenser pressures can arise that are five to ten times larger than those in winter. Since a larger pressure difference at a given open position of the valve leads to a higher throughflow quantity, entirely different control conditions are obtained in the summer than they are in winter.

For this reason it is already known (U.S. Pat. No. 2,922,292 ) to have an upstream valve as the first throttle point and a thermostatic expansion valve connected downstream thereof as the second throttle point. In a known valve arrangement, the upstream valve is loaded in the closed direction by the mean pressure between the two throttle points and in the open direction by air-filled bellows. The dimensions of the bellows are such that there is substantial relief in relation to the condenser pressure. With this arrangement, therefore, the mean pressure is approximately held at a value corresponding to the air pressure in the bellows. This takes the influence of the fluctuating condenser pressure into account to a large extent but external influences still have a disturbing influence on the control behaviour.

In another known embodiment (German Pat. No. 2,340,836), the upstream first throttle point is loaded in the closed direction by the condenser pressure and in the open direction by the evaporator pressure and a differential spring. Here, too, an excessively high condenser pressure can be reduced in that even during winter operation the thermostatic expansion valve operates with a comparatively large opening cross-section as is necessary for summer operation. This results in a mean pressure that is governed by the respective pressure loading and by the degree of opening of the two throttle points.

The invention is based on the problem of providing a valve arrangement of the aforementioned kind in which the control characteristic of the expansion valve is even less dependent on external influences.

This problem is solved according to the invention in that the opening force is predetermined by the evaporator pressure acting on a pressure face and a substantially constant differential force such as a differential spring.

With this construction, it is ensured that the mean pressure is always larger than the evaporator pressure by a predetermined difference. Since the same pressure difference will therefore always be applied to the thermostatic expansion valve, the same control characteristic will obtain under all operating conditions. This is irrespective of what pressure conditions obtain in the condenser by reason of different condenser temperatures and what pressure conditions obtain in the evaporator in dependence on the temperature in the refrigerated chamber, operation of the compressor, or the like. A differential spring, a gas spring or the like may serve to produce the differential force.

It has been found that with a given open position of the second throttle point, the refrigerating effect of the refrigerant that is allowed to pass reduces somewhat with an increase in condenser pressure even though the difference between the mean pressure and the evaporator pressure is kept exactly constant. This phenomenon seems to arise from a change in the heat content (enthalpy) of the refrigerant governed by the condenser pressure and the associated condenser temperature. This departure from the desired constant value can be avoided in that the first throttle point is partially relieved in relation to the condenser pressure such that an additional opening force is created. The partial relief can readily be selected so that practically complete compensation takes place.

In a preferred embodiment, it is ensured that the first throttle point is formed by a cylindrical nozzle and a cone engaging therein, that an operating element such as a piston connected to the cone by a shank is loaded on the one side by the mean pressure and on the other side by the evaporator pressure and a differential spring, and that the shank passes through the supply chamber connected to the condenser and is provided on the side opposite to the cone with a piston-like enlargement of which the cross-sectional area is approximately equal to the cross-sectional area of the cone. In this construction, the nozzle can be relieved from the condenser pressure by selecting the cross-section of the piston-like connection. On the other hand, the cross-sectional area of the operating element is independent of the cross-sectional area of the nozzle. One can therefore apply adequately large setting forces. The operating element need not be a piston but can also be a diaphragm or bellows.

The partial relief desired for compensating purposes is very simply achieved in that the piston-like enlargement has a somewhat smaller cross-sectional area than the cone.

A very simple construction is obtained if the shank has a throughpassage connecting the chamber between the throttle points to the one side of the operating element.

It is also favourable if a common valve housing is provided in which two inserts or attachments are placed from opposite sides, each having one throttle point with associated operating element. The valve housing has an inlet nipple and an outlet nipple, i.e. it can be built into the train of conduits in the same way as a normal expansion valve. The two inserts or attachments can be independently fabricated and adjusted and then built into the common valve housing.

The invention will now be described in more detail with reference to the example illustrated in the drawing, wherein.

Figure 1:
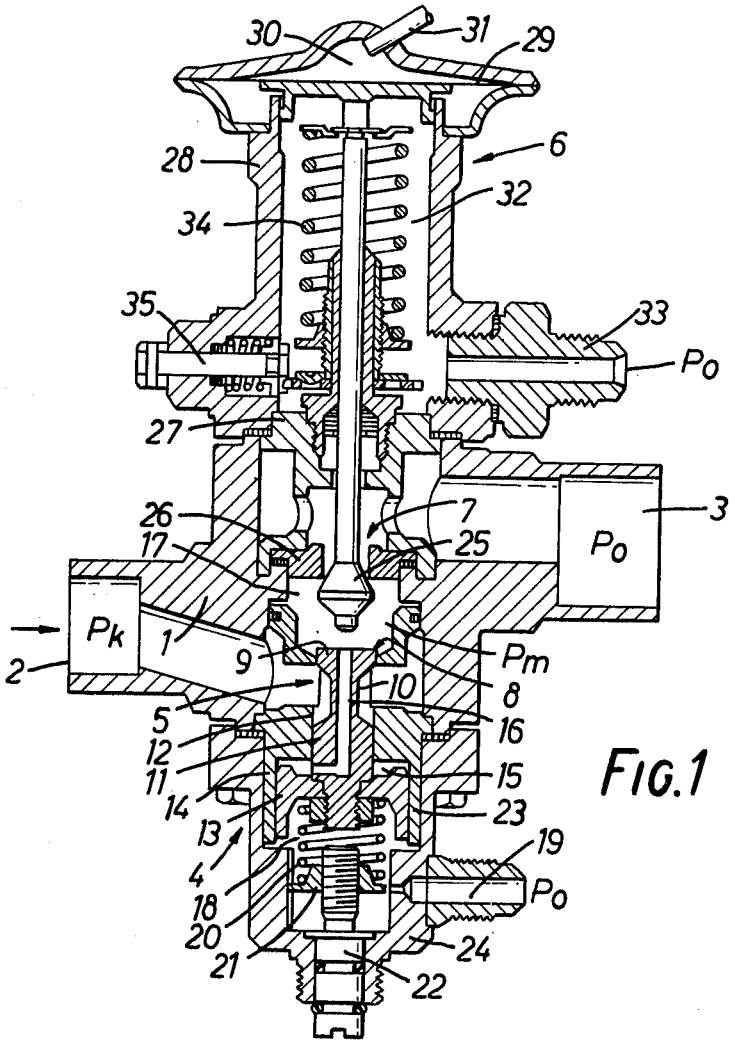
FIG. 1 is a longitudinal section through a valve arrangement according to the invention.

A valve housing 1 has an inlet nipple 2 and an outlet nipple 3. It comprises a first insert 4 for a first throttle point 5 and a second insert 6 for a second throttle point 7.

The first insert 4 comprises a cylindrical nozzle 8 co-operating with a cone 9. A valve shank 10 is extended by a piston-like enlargement 11 guided in a bore 12 of the housing. The other end of the shank 10 is connected to a piston 13 guided in a cylinder 14. Piston 13 sub-divides the interior of the cylinder 14 to form first and second chambers 15 and 18. Chamber 15 is connected by a channel 16 extending through the shank to a chamber 17 between the two throttle points 5 and 7. The second chamber 18 is connectable to the evaporator by a nipple 19 and therefore has the pressure $P_o$ and houses a differential spring 20. Spring 20 is on the one hand supported by the piston 13 and on the other hand by a plate 21 which can be axially displaced by means of a set screw 22 to set the desired value of the spring. The nozzle 8, cylindrical bore 12 and cylinder 14 are formed on a first insert portion 23 over which there engages a second attachment 24 which can be screwed to the housing 1. The insert 6 forms a thermostatic expansion valve. A valve cone 25 co-operates with a nozzle 26 which is mounted in a recess of an insert portion 27. An attachment 28 can be screwed to the housing 1. This attachment carries a diaphragm 29 closing a pressure chamber 30 which communicates by way of a capillary tube 31 with a senser at the evaporator outlet. The interior 32 is again supplied with the evaporator pressure $P_o$ by way of a nipple 33. A desired value spring 34 adjustable by means of a set screw 35 permits the desired value of the temperature to be set accurately.

Figure 2:
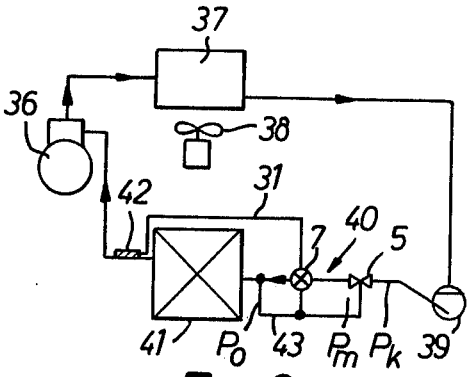
FIG. 2 is a circuit diagram for building in this valve arrangement.

FIG. 2 illustrates a circuit for a refrigeration plant, in which a compressor 36 conveys gaseous refrigerant to a condenser 37 which is cooled with air by a fan 38. The thus liquefied refrigerant is collected in a collector 39. It is passed into the evaporator 41 by the valve arrangement 40 shown in FIG. 1 and consisting of the first throttle point 5 and the second throttle point 7. A sensor 42 at the evaporator outlet communicates by way of the capillary tube 31 with the thermostatic expansion valve forming the second throttle point 7. A conduit 43 leads the evaporator pressure $P_o$ to the throttle operating gear for the two throttle points 5 and 7. The condenser pressure $P_k$ therefore obtains at the inlet nipple 2 and the evaporator pressure $P_o$ obtains at the outlet nipple, whilst an intermediate pressure $P_m$ obtains in the chamber 17 between the two throttle points.

The manner of operation is as follows. The first throttle element 5 is brought to the open position under the influence of the differential spring 20 and the evaporator pressure $P_o$. A condenser pressure $P_k$ is reduced to the mean pressure $P_m$ at this throttle point. The throttle point therefore assumes a position in which this mean pressure $P_m$ lies above the evaporator pressure $P_o$ by an amount predetermined by the differential spring. If the condenser pressure rises, the mean pressure would also rise but this leads to closing of the throttle point until equilibrium has again been established. The second throttle point 7 is therefore always subjected to the differential pressure $P_m - P_o$. This results in a defined characteristic control line independent of the condenser pressure and the evaporator pressure.

Figure 3:
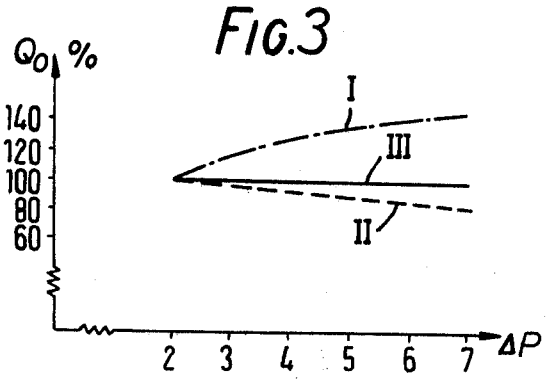
FIG. 3 is a graph of the refrigerating effect to the pressure difference between the condenser pressure and the evaporator pressure.

FIG. 3 diagrammatically illustrates for the fully open condition the percentage refrigerating effect $Q_o$ of the flowing refrigerant normally measured in Kcal/h against the difference $\Delta P = P_k - P_o$. If only the second throttle point 7 were to be provided, one would obtain the chain-dotted curve I. The throughflow quantity increases with a rise in condenser pressure.

When the first throttle point has been completely relieved of the condenser pressure, i.e. the cross-sectional area of the cone 9 is equal to the cross-sectional area of the piston-like enlargement 11, one obtains the curve II. It tends to drop slightly with an increase in $\Delta P$.

If, however, the cross-sectional area of the cone 9 is selected to be somewhat larger than the cross-sectional area of the piston-like enlargement 11, i.e. there is only partial relief from the condenser pressure, one can obtain a curve III which represents a practically constant refrigerating effect.

I claim:

1. A valve assembly for a refrigeration system having a condenser and an evaporator, comprising, a casing defining a condenser inlet passage and an evaporator outlet passage, first and second throttle valve means in series between said inlet and outlet passages and forming a mean pressure chamber between said first and second valve means, said second valve means being a thermostatic expansion valve unit operable in response to the temperature of the refrigerant leaving said evaporator, said first throttle valve means being biasable in a closing direction by pressurized fluid from said mean pressure chamber, said casing defining an evaporator feedback passage which is connectable to said evaporator outlet passage, said first throttle valve means being biasable in an opening direction by pressurized fluid from said evaporator feedback passage, and differential spring means also biasing said first throttle valve means in an opening direction.

2. A valve assembly according to claim 1 wherein said first throttle valve means includes a cylindrically shaped nozzle and a cone shaped closure element cooperable therewith, piston means carried by said closure element and forming first and second chambers in cooperation with said casing, said first chamber having fluid communication with said evaporator feed back passage and said second chamber having fluid communication with said mean pressure chamber, said first throttle valve means including first and second oppositely facing surfaces of equal area in fluid communication with said condenser inlet passage.

3. A valve assembly according to claim 2 wherein each of said oppositely facing surfaces is cone shaped.

4. A valve assembly according to claim 2 wherein passage means in said closure element providefluid communication between said mean pressure chamber and said second chamber.

* * * * *